United States Patent [19]

Mueller

[11] 4,046,330

[45] Sept. 6, 1977

[54] STRAND COLLECTING APPARATUS AND METHOD

[75] Inventor: Dale R. Mueller, Toledo, Ohio

[73] Assignee: Owens-Corning Fiberglas Corporation, Toledo, Ohio

[21] Appl. No.: 724,826

[22] Filed: Sept. 20, 1976

[51] Int. Cl.[2] ..... B65H 54/00; B65H 54/38

[52] U.S. Cl. ..... 242/18 G; 242/43 R

[58] Field of Search ..... 242/18 G, 18 R, 43, 242/45, 18 PW; 65/11 R, 11 W

[56] References Cited

U.S. PATENT DOCUMENTS

| | | | |
|---|---|---|---|
| 2,391,870 | 1/1946 | Beach | 242/43 |
| 3,861,609 | 1/1975 | Klink et al. | 242/45 |
| 3,897,021 | 7/1975 | Shape | 242/18 G |
| 3,901,455 | 8/1975 | Carlisle | 242/18 G |
| 3,924,817 | 12/1975 | Symborski | 242/18 G |

*Primary Examiner*—Leonard D. Christian
*Attorney, Agent, or Firm*—Ronald C. Hudgens; Philip R. Cloutier; Ted C. Gillespie

[57] ABSTRACT

A strand collecting apparatus and method of the type in which the strand is advanced by, and wound onto, a rotating collet are disclosed. The strand is traversed linearly of the axis of rotation of the collet by the rotation of the strand traverse, and a strand guide means oscillates in phase with the strand traverse to guide the strand into engagement with the strand traverse. The oscillation of both the strand guide means and the strand traverse is sensed, and the oscillation of the strand guide means or the strand traverse is altered responsive to the sensing to maintain the oscillation of the strand guide means in phase with the oscillation of the strand traverse.

9 Claims, 2 Drawing Figures

STRAND COLLECTING APPARATUS AND METHOD

The present invention relates to the collecting of strands of material. More particularly this invention relates to the winding of strands on a rotating drum to form a package. The strands can consist of glass fibers, or can be comprised of fibers of other mineral materials or synthetic resin materials.

In strand collecting operations widespread use of rotating drums, or collets, is made in order to wind the strand into packages. In order to form a helical winding pattern on the package and prevent adjacent loops or wraps of strand from fusing together should the strand still be wet from the application of a protective size material, it has been found advantageous to traverse the strand with a strand traverse, longitudinally of the axis of the collet in a helical pattern on the collet rather than in a circular pattern.

The spiral wire traverse shown in U.S. Pat. No. 2,391,870 to Beach has proven to be a very effective strand traverse apparatus for traversing the strand at the high rates of speed necessary for efficient collecting of strand.

Developments in the art of collecting strand have resulted in the use of a strand traverse which oscillates in a direction parallel to the axis of rotation of the collet. This oscillation permits the collection of the strand into a longer and larger package. A typical strand traverse can be operated with a 10-second period of oscillation.

Further developments in the art of collecting strand have resulted in the use of a strand guide means which oscillates in phase with the strand traverse to guide the strand into engagement with the strand traverse. U.S. Pat. No. 3,901,455 to Carlisle discloses a strand collecting operation utilizing a strand guide means oscillating in phase with a strand traverse.

U.S. Pat. No. 3,041,664 issued to Green discloses a strand collecting apparatus in which a strand guide means is oscillated in phase with a strand traverse in order to gather fibers into a strand. The apparatus of Green depends upon a mechanical connection between the strand traverse and the strand guide to provide in-phase oscillation.

In some strand collecting operations, the connection or inter-relationship between the oscillating strand traverse and the oscillating strand guide means is electrical rather than mechanical. In such an operation the strand guide means can be operated responsive to a signal generated by the oscillation of the strand traverse. Also, both the strand traverse and strand guide means can be operated responsive to the same signal source. An example of a situation requiring an electrical connection between the strand guide means and the strand traverse is one in which space limitations prohibit a mechanical connection.

Due to mechanical limitations of the apparatus providing the oscillatory motion to the strand traverse and the strand guide means, there has heretofore been a problem in maintaining the oscillation in phase. After a period of hours or days it has been the experience with electrically connected oscillating strand traverse and strand guide means that they become out of phase with each other.

It has been found that an improved strand collecting method and apparatus can be made in which a strand traverse and strand guide means are electrically connected to oscillate in phase with each other, deviations in the in-phase oscillation are sensed, and the oscillation of either the strand traverse or the strand guide means is corrected to restore the condition of in-phase oscillation.

Accordingly, there is provided an improved method and apparatus for collecting strand on a rotating collet in which a strand traverse and a strand guide means are oscillated in phase with each other.

There is also provided an improved strand collecting method and apparatus in which a strand traverse for guiding the strand onto a rotating collet is oscillated linearly of the axis of the collet and a strand guide means to guide the strand onto the strand traverse is oscillated in phase with the strand traverse. The oscillation of both the strand traverse and the strand guide means is sensed, and means responsive to the sensing are provided to maintain the condition of in-phase oscillation between the strand traverse and the strand guide means.

This invention will be more fully understood by reference to the following drawings.

The following description of the preferred embodiment which comprises a glass fiber forming and collecting operation is offered for purposes of illustration of the principles of this invention, and is not intended to be limiting.

Figure 1:
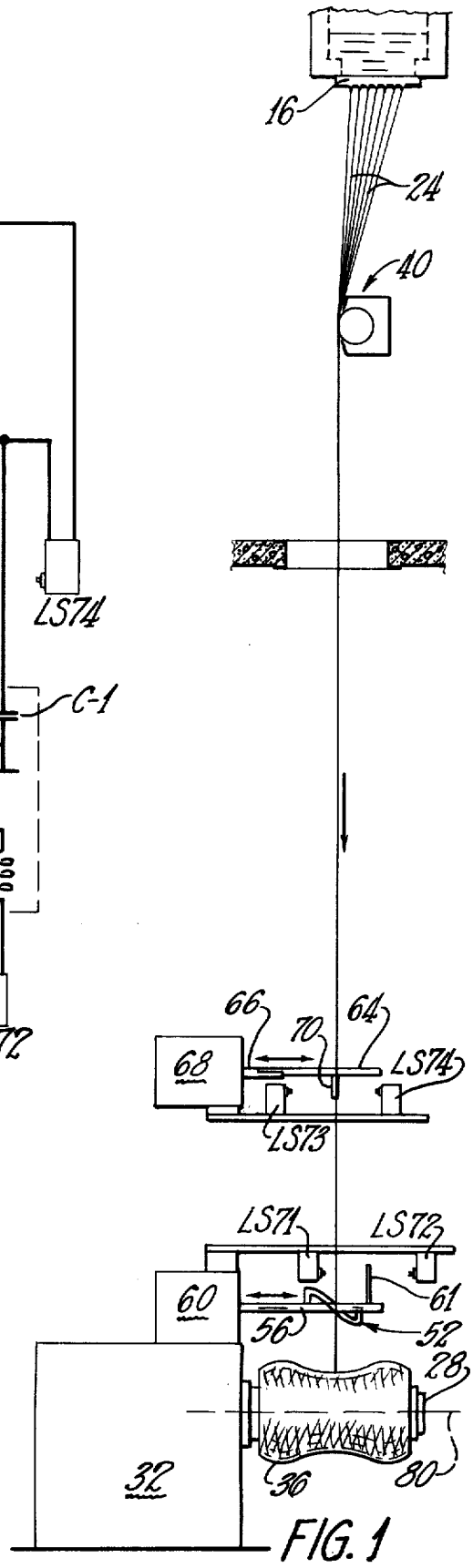
FIG. 1 is a diagrammatic view of apparatus showing a rotatable collet and oscillatable strand guide means and strand traverse according to principles of this invention.

In FIG. 1, there are shown strands 24 being pulled from bushing 16 and collet 28 which can be rotated by any suitable means 32. As the strand is wound onto the collet, a package 36 is formed. Prior to being wound on the collet the fibers in the strand can be contacted by size applicator 40 which imparts a protective size.

Prior to reaching the collet the strand is traversed with strand traverse 52 which oscillates the strand longitudinally of the axis of the collet to create a helical winding pattern on the package. The strand traverse is rotated on strand traverse shaft 56 by a source not shown. Reverse synchronization motor 60 imparts a horizontal oscillatory motion to the strand traverse and shaft as shown by the horizontal arrow in FIG. 1. The strand traverse oscillates along a line parallel to the axis of rotation 80 of the collet. As the strand traverse oscillates, trip means 61 periodically and alternately trips limit switch 71 and limit switch 72, hereinafter LS71 and LS72, mounted in a stationary position. The periodic activation of these limit switches causes motor 60 to reverse, and thus the strand transfer is given an oscillatory motion. The sequencing of the limit switches and reversing of the motor will be more fully described later.

Strand guide means 64 is positioned adjacent the collet to guide the strand onto the strand transfer. The strand guide means can be a strand splitter as disclosed in Carlisle, supra. Alternatively, the strand guide means can be any suitably shaped member which bunches the fibers into a single strand. The strand guide means is mounted on shaft 66 for oscillation along a line parallel to the line of oscillation of the strand traverse. Reverse synchronization motor 68 provides the oscillatory motive force for the strand guide means and shaft.

As will be shown later, a single power circuit can supply the power for driving both the strand guide means motor 68 and the strand transfer motor 60. When the polarity of the power supplied to the motors is reversed, the motors reverse direction and reverse the direction of travel of the strand guide means and the strand transfer.

The strand guide means optimally oscillates in phase with the strand transfer. As the strand guide means oscillates, trip means 70 periodically trips limit switch 73 and 74, hereinafter LS73 and LS74. The tripping of either LS73 or LS74 causes the strand guide means to stop in its traverse. If the strand guide means is ahead of the strand transfer in the traverse and LS71 or LS72 are tripped, the strand guide means will remain in the stopped position until the strand transfer is again in phase with the strand guide means, as will be more fully described herein.

Figure 2:
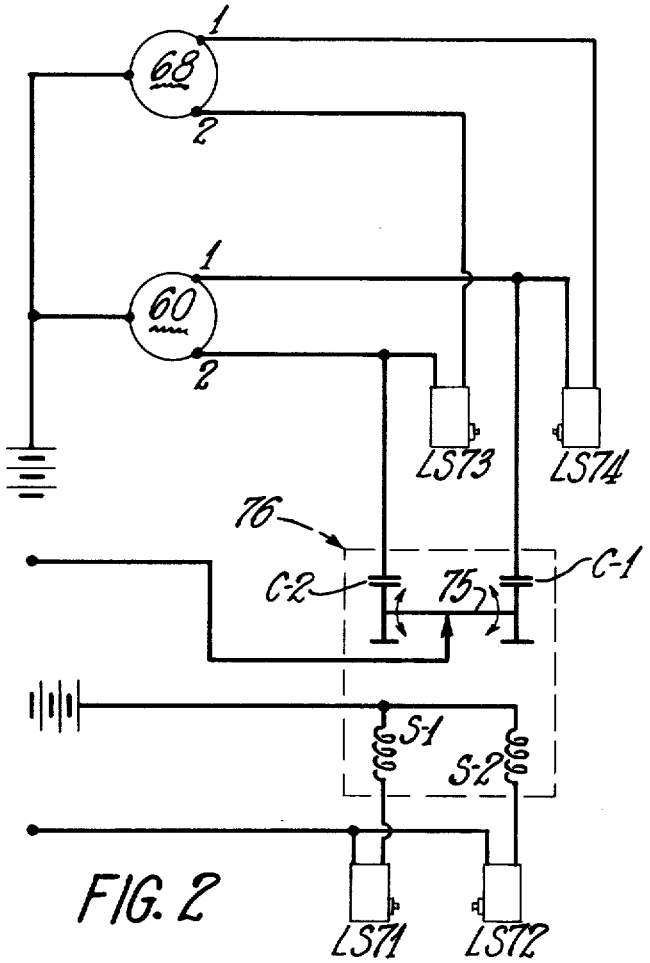
FIG. 2 is a control diagram for the apparatus shown in FIG. 1.

By reference to the control diagram of FIG. 2, the preferred embodiment of the strand winding operation of this invention can be more fully understood. As the strand traverse and strand guide means begin to traverse the length of the collet away from the motors, LS71 and LS74 are in an ON condition and both LS72 and LS73 are in an OFF condition. The ON condition of LS71 activates solenoid S-1 to pull arm 75 of latching relay 76 and close contact C-1. Thus, current will be entering side 1 of both reverse synchronization motors. Under conditions of normal in-phase operation, LS74 will be tripped at the end of the traverse by trip means 70 at the same time LS72 is tripped by trip means 61. The tripping of LS72 leaves it in an ON condition and leaves LS71 in an OFF condition. The tripping of LS72 changes it to an ON condition and changes LS71 to an OFF condition. The tripping of LS74 leaves it in an OFF condition and leaves LS73 in an ON condition. Changing LS72 to the ON condition activates Solenoid S-2 to pull the arm of the latching relay to close contact C-2 and open contact C-1. The current is then entering side 2 of both reverse synchronization motors, causing both the strand traverse and the strand guide means to reverse direction and to travel back toward the motors. Upon reaching the end of the traverse, LS71 and LS73, and Solenoid S-1 will again be activated and the cycle will be repeated.

In a situation where the strand guide means becomes out of phase with, and travels ahead of, the strand traverse, LS74 will be tripped to an OFF condition prior to the tripping of LS72. In such a case the strand guide means merely remains stationary at the end of its traverse for a time sufficient for the strand traverse to complete its traverse and for LS72 to be tripped. When LS72 is so tripped (to an ON condition) Solenoid S-2 is activated, closing contact C-2, and both motors begin at the same time. A similar phase correction will take place if the strand guide means should complete its return traverse prior to the completion of the return traverse by the strand traverse, i.e., LS73 will be tripped, stopping the strand guide means at the end of its return traverse until LS71 is tripped.

In a situation where the strand guide means lags behind the strand traverse, LS72 will be tripped before LS74 can be tripped, i.e., before the strand guide means has completed its traverse. The tripping of LS72 will reverse both mtors and, in this instance, the strand guide means will now be ahead of the strand traverse and will complete its return traverse before the strand traverse completes its return traverse. This, then, merely presents the situation in which the strand guide means completes a traverse prior to the strand traverse. LS73 is tripped and the strand guide means stops traversing until the strand traverse can complete its return traverse.

Various modifications of the above described embodiment of the invention will be apparent to those skilled in the art, and it is to be understood that such modifications can be made without departing from the scope of the invention.

I claim:

1. Apparatus for collecting a strand on a rotating collet comprising:

a strand traverse for traversing a strand linearly of the axis of rotation of said collet;

means for oscillating said strand traverse linearly of said axis;

strand guide means for guiding said strand into engagement with said strand traverse;

means for oscillating said strand guide means linearly of said axis;

means for sensing the oscillation of said strand traverse and said strand guide means; and, means for altering the rate of oscillation of said strand traverse or said strand guide means responsive to said sensing means to maintain the oscillation of said strand traverse in phase with the oscillation of said strand guide means.

2. The apparatus of claim 1 in which said strand guide means is a splitter means for dividing said strand.

3. The apparatus of claim 2 in which said means for sensing comprises limit switches activated by said strand traverse and said splitter means.

4. The apparatus of claim 3 in which said means for oscillating said splitter means comprises a reverse synchronization motor and one of said limit switches is activated by said splitter means to stop the flow of current to said reverse synchronization motor.

5. The apparatus of claim 4 in which said means for oscillating said strand traverse comprises a reverse synchronization motor, and one of said limit switches is adapted upon the activation of said strand traverse to reverse the polarity of current flowing to each of said reverse synchronization motors.

6. A method for collecting strand on a rotating collet comprising:

traversing said strand into contact with said collet by means of an oscillating strand traverse;

guiding said strand into engagement with said strand traverse with an oscillating strand guide means;

sensing the oscillation of said strand traverse and said strand guide means; and, altering the rate of oscillation of said strand traverse or said strand guide means responsive to said sensing to maintain the oscillation of said strand traverse in phase with the oscillation of said strand guide means.

7. The method of claim 6 including the step of dividing said strand with said strand guide means.

8. The method of claim 7 in which said strand traverse and said strand guide means activate limit switches in said sensing step.

9. The method of claim 8 in which said oscillating of said strand traverse and said strand guide means is effected by driving said strand traverse and said strand guide means with reverse synchronization motors, including reversing the polarity of the current to said reverse synchronization motors upon the activation of at least one of said limit switches.

* * * * *